US005129292A

United States Patent [19]

Albert

[11] Patent Number: 5,129,292

[45] Date of Patent: Jul. 14, 1992

[54] DISPOSABLE HOLDER FOR STARTING SCREWS

[75] Inventor: Jeffrey D. Albert, Yorba Linda, Calif.

[73] Assignee: Ocean Shore Toys, Los Angeles, Calif.

[21] Appl. No.: 651,552

[22] Filed: Feb. 6, 1991

[51] Int. Cl.[5] ..... B25B 23/00

[52] U.S. Cl. ..... 81/452; 248/546; 411/441

[58] Field of Search ..... 81/451, 452; 248/546, 248/909; 411/441, 371, 372

[56] References Cited

U.S. PATENT DOCUMENTS

| | | | |
|---|---|---|---|
| 1,779,339 | 10/1930 | Sokoloff | 81/452 |
| 2,723,694 | 11/1955 | Ross | 81/451 |
| 3,498,172 | 3/1970 | Thurner | 411/441 |
| 3,517,714 | 6/1970 | Desbarats | 81/451 |
| 4,221,249 | 9/1980 | Mazzeo et al. | 81/451 |
| 4,436,273 | 3/1984 | Yuda et al. | 248/909 X |
| 4,526,072 | 7/1985 | Manhoff, Jr. | 81/452 X |
| 4,704,929 | 11/1987 | Osada | 81/451 |
| 4,719,828 | 1/1988 | Corsetti | 81/451 |
| 4,736,658 | 4/1988 | Jore | 81/451 |
| 4,979,354 | 12/1990 | Johnson et al. | 81/451 |

FOREIGN PATENT DOCUMENTS

| | | | |
|---|---|---|---|
| 2605542 | 4/1988 | France | 81/451 |
| 737968 | 10/1955 | United Kingdom | 411/441 |
| 966781 | 8/1964 | United Kingdom | 411/441 |
| 2170744 | 8/1986 | United Kingdom | 81/451 |

*Primary Examiner*—David L. Talbott
*Attorney, Agent, or Firm*—Natan Epstein

[57] ABSTRACT

A screw starter has a generally cylindrical tubular sleeve sized for closely receiving the screw head, an open upper end, and an opposite lower end with a closure designed to hold the screw point centered in the sleeve, holding the screw perpendicular to the surface into which the screw is driven. The closure is ruptures to pass the screw and the starter is discarded after use. Diametrically opposed slots in the sleeve admit a wide screw driver blade into engagement with the screw head in the sleeve. Two sleeves can be joined end to end for starting a screw longer than either sleeve alone.

14 Claims, 1 Drawing Sheet

Fig. 1
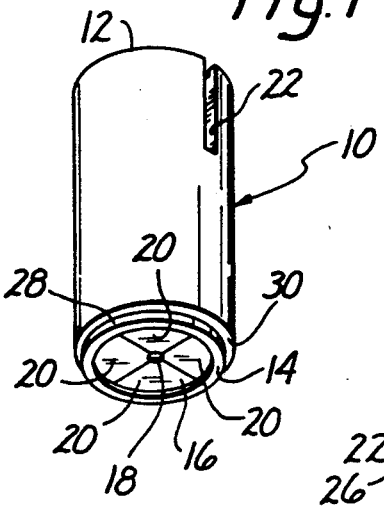
Fig. 5
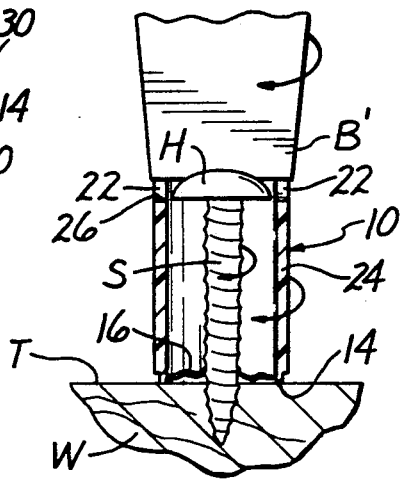
Fig. 6
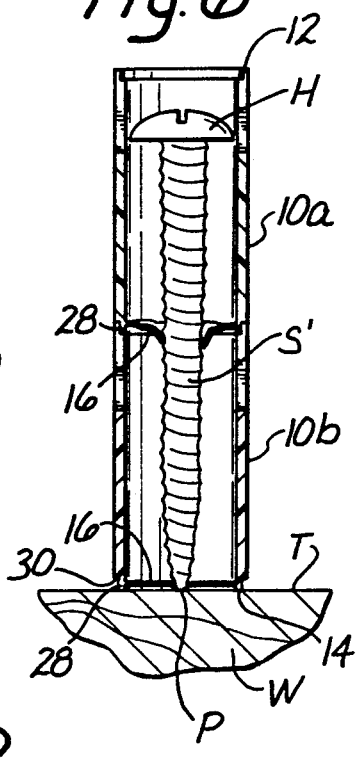
Fig. 2
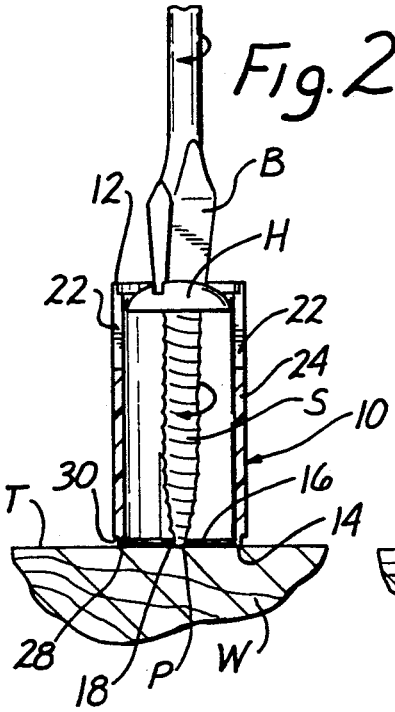
Fig. 3
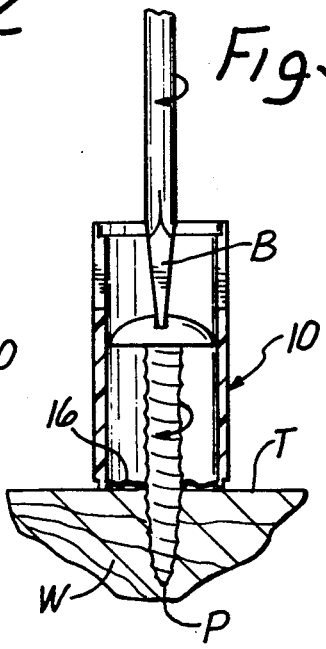
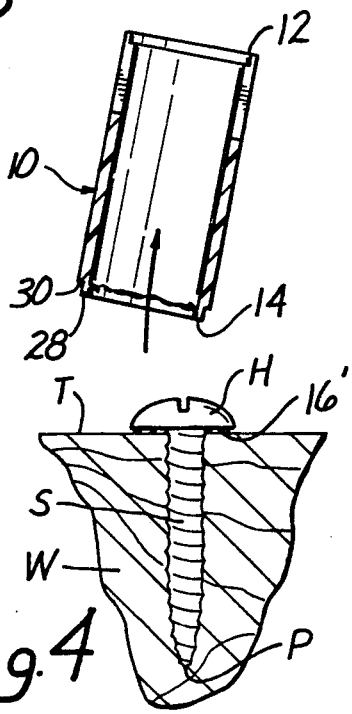
Fig. 4

DISPOSABLE HOLDER FOR STARTING SCREWS

BACKGROUND OF THE INVENTION

1. Field of the Invention

The present invention relates to the field of screw starter devices for temporarily holding a screw while it is started into a workpiece. The device is particularly useful for starting wood screws with a pointed end.

2. Description of the Prior Art

The most difficult stage in the driving of a screw into a workpiece or substrate is the starting of the screw in the proper place and at the correct angle to the workpiece surface. This is particularly true of wood screws which are typically started into a surface without benefit of a pilot hole or a punch hole to guide the screw point. This difficulty is compounded when the screw must be installed in a situation offering limited work room, or where the screw may be lost if dropped, or where the worker must reach for the workpiece. This is specially true of less experienced craftspersons who may have only occasional need to install a screw, as for example a homeowner or housewife.

In recognition of this need, various screw holding devices have been developed to facilitate this task, as for example, U.S. Pat. No. 4,719,828 issued to Corsepti on Jan. 19, 1988 and U.S. Pat. No. 4,526,072 issued to Manhoff, Jr., on July 2, 1985. Nevertheless, further improvement in screw holders and starters is desirable with the aim of achieving greater ease of use, particularly for the inexperienced or occasional user. In particular it is desirable to provide a low cost disposable screw holder which can be purchased inexpensively as the need may arise, in contrast with earlier non-expendable tools which once purchased are easily misplaced after a first use and are unavailable when the need again arises.

The object of a screw starter is generally two fold. Firstly, the starter device serves as a larger and easier to grasp holder, which is larger and easier to hold than their screw. The starter device also holds the screw in perpendicular relationship to the surface into which it is being driven, especially during the starting stage when the screw can easily become skewed and enter the workpiece at an undesirable oblique angle.

SUMMARY OF THE INVENTION

The present invention addresses these and other needs by providing a holder sleeve for starting a screw into a workpiece, particularly a pointed screw with a slotted screw head. The holder is a tubular sleeve having an open upper end for receiving the screw to driven, and an opposite lower end provided with a partial closure configured for supporting the point of the screw centered in the sleeve. The bottom closure may take the form of a thin wall or membrane with a center hole for receiving the screw point. The thickness of this membrane is adapted to yield with relative ease to the advance of the screw into a workpiece positioned against the lower end of the sleeve. The inside dimension of the tubular sleeve is desirably such as to closely receive the outer rim of the screw head. A screw inserted point first into the open end of the sleeve is thus supported in axial alignment with the sleeve at its two ends, namely, at the screw head and at the opposite point end of the screw. It is contemplated that the screw holder of this invention will be supplied in various diameters, each corresponding to a particular standard screw number. A given sleeve length, however, is useful with screws of different lengths, i.e., lengths equal or shorter than the sleeve length. The holder sleeve may have diametrically opposed longitudinal slots terminating at the upper end of the sleeve for admitting a screw driver blade wider than the sleeve interior diameter into engagement with the slotted screw head in the sleeve.

To further increase the usefulness of the novel screw starter and holder of this invention, the tubular sleeve may be provided at its lower end with a coupling adapted to mate with the upper end of a second similar sleeve, with the object of extending the sleeve length for use with a screw longer than either sleeve alone. The bottom closure of the upper sleeve yields to the screw as it is pushed through into the lower sleeve and its screw point brought into supporting relationship with the bottom closure of the lower sleeve. Again the sleeve is supported in axial alignment at the screw head and at the screw point within the two coupled sleeves.

In a presently preferred form of the invention, the coupling is an annular shoulder defined at the lower end of the sleeve by an annular flange projecting axially from the bottom end of the sleeve. The interior of the annular flange defines a lower end aperture of the sleeve which, in an initial condition of the sleeve, is partially closed by a thin disc which yields by destructive failure when the screw is advanced into a workpiece.

It is presently preferred to make the sleeve of an injection moldable plastic material and the bottom closure integral with the sleeve. The closure may consist of a thin disc cut into four quadrant shaped segments joined to the sleeve wall along the disc circumference but unsupported along the diametric edges or the center, so as to readily yield under the advance of the screw point through the center hole.

Once the screw is securely started into the workpiece, the holder sleeve may be pulled off the screw. The disc segments comprising the bottom closure fold outwardly or tear off to allow passage of the screw head through the bottom end of the sleeve, leaving the screw exposed so that its installation into the workpiece may be completed. The screw may be driven partially or fully into the workpiece before the holder sleeve is pulled off. The holder sleeve once so used is discarded.

These and other features and advantages of the present invention will be better understood by reference to the following description of the preferred embodiments and the attached drawings.

BRIEF DESCRIPTION OF THE DRAWINGS

FIG. 1 is a perspective view of a screw starter sleeve according to the present invention;

FIG. 2 shows in longitudinal section the screw starter sleeve of FIG. 1 in use to start a typical wood screw into a workpiece positioned against the lower end of the sleeve;

FIG. 3 is a view as in FIG. 2 showing the screw partially driven into the workpiece;

FIG. 4 is a view as in FIG. 3 showing the sleeve after being pulled away from the screw which has been fully driven into the workpiece;

FIG. 5 is a view as in FIG. 2, showing how the longitudinal slots in the sleeve allow a wide screwdriver blade to engage the screw head within the sleeve;

FIG. 6 shows the use of two sleeves coupled together for starting a long screw into a workpiece.

DETAILED DESCRIPTION OF THE PREFERRED EMBODIMENTS

With reference to the drawings, FIG. 1 shows a screw starter 10 according to this invention which is variously referred to below as a holder sleeve, screw holder or simply the sleeve. The sleeve 10 in its presently preferred form is generally a cylindrical tube with an upper end 12 which is open to admit a wood screw S (shown in FIGS. 2 through 6), and a lower end 14 which is partially closed by a point supporting bottom closure disc 16 with a center hole 18. The point P of the screw fits into the center hole and is held centered within the cylindrical interior of the sleeve 10. The disc 16 is sectioned by mutually perpendicular diametric cuts into four quadrants or pie-wedge shaped segments 20. Each segment 20 is attached to the wall of the sleeve 10 only at its circumferential outer edge, and is not attached to either of the adjacent segments or the diametrically opposed segment 20. It is presently preferred to make the entire sleeve 10 of an injection moldable plastic material with the bottom closure 16, segmented as shown in FIG. 1, being formed integrally with the sleeve wall 24.

FIG. 2 shows in longitudinal section the sleeve 10 which has been placed with its lower end 14 against a surface T of a workpiece W which, for purposes of this explanation, may be assumed to be a block of wood. Screw S is a typical wood screw with a round slotted head H, and terminates at its opposite end in a screw point P.

The sleeve 10 has a cylindrical sleeve wall 24 with an inside diameter slightly larger than the diameter of the screw head H, so that in an axial position of the screw S within the sleeve 10 the head H is held against substantial lateral movement. The screw point P enters into the center hole 18 in the bottom closure 16 and is likewise held therein against lateral movement in the sleeve 10. As a result, screw S is held at both ends, namely at the head H and point P against side displacement within the sleeve S, in coaxial alignment with the sleeve 10. This coaxial alignment is maintained as the screw is driven into the workpiece W since the point P is not movable sideways within the workpiece W, while the head H remains captive within the sleeve 10 until the screw is fully driven into the workpiece W, or until the sleeve 10 is pulled off the screw S before the screw is fully driven into the workpiece.

The sequence of FIGS. 2, 3 and 4 illustrates typical use of the sleeve 10. The screw S is matched to a sleeve 10 of equal or greater length than the screw length, so that the screw head H is contained within the sleeve as shown in FIG. 2. The screw S is inserted into the sleeve 10 to bring the point P into the center hole 18. The lower end 14 of sleeve 10 is then placed against the surface T of the workpiece W into which the screw is to be driven. The lower end 14 of the sleeve 10 is configured to support the sleeve upright on a plane workpiece surface T, thus supporting the screw S in perpendicular relationship to the workpiece surface. The screw point P will be either in contact with the workpiece surface T as it extends through the bottom center hole 18, or can readily brought into such contact due to the yielding nature of the bottom closure 16.

A screw driver blade B or equivalent tool is inserted into the open upper end 12 of the sleeve 10 and fitted into the slot of the screw head H. If the width of the blade B is lesser than the diameter of the end opening of the sleeve, the blade B is inserted without difficulty into the sleeve 10. The sleeve may be held between the fingers of the craftsman while the screw S is turned with the blade B, as suggested by the arrows in FIGS. 2 and 3.

The holder sleeve 10 also has two diametrically opposed longitudinal slots 22 which terminate at the upper end 12 of the sleeve, and may extend approximately one third of the sleeve length towards the bottom end 14. It is contemplated that more than one pair of such diametrically opposed slots may be provided in the sleeve 10. If a screw driver blade B', shown in FIG. 5, wider than the inside diameter of the sleeve 10 is used, the blade B' is inserted into the lateral slots 22, which allows the blade to be brought into driving engagement with the screw head H. In this situation, the sleeve 10 must turn together with the blade B prime and the screw S, as indicated by the arrows in FIG. 5. Also, the sleeve 10 must be pulled of the screw S once the screw has been driven below the ends 26 of the two slots 22, beyond which the blade B' cannot advance. At that stage, the blade B' is withdrawn and the sleeve 10 pulled off to expose the screw S and allow the blade B' to fully drive the screw into workpiece W.

FIGS. 3, 4 and 5 illustrate the destructive yielding of the bottom closure 16 as the increasing thickness of the threaded screw shaft is forced through the center hole 18. The closure 16, a thin membrane of plastic material has sufficient rigidity to support the screw point P in the sleeve, but readily crumples or tears to allow passage of the screw as the screw is turned into the workpiece W, as shown in FIGS. 3 and 5. If the sleeve 10 is pulled off the screw S, even greater destructive damage occurs to the closure 16 as the enlarged screw head H is pulled through the closure. If the screw S has been fully driven into the workpiece W prior to withdrawal of the sleeve 10, fragments 16' of the closure disc 16 may be torn off and captured between the screw head H and the workpiece surface T, as illustrated in FIG. 4. Such fragments can be ignored in most cases and will not usually interfere with the function of the screw S. They can, if desired, be easily removed by withdrawing the screw S a turn or two from the Workpiece W, clearing the fragments 16', and again driving the screw S into the workpiece W. If on the other hand, the sleeve 10 is pulled off the screw S before the screw head H is driven against the workpiece surface T, no such fragments 16' are likely to separate from the sleeve 10.

The lower end 14 of sleeve 10 has a ring or circular flange 28 of reduced diameter which projects axially from the end of the sleeve wall to define a circumferential end shoulder 30. The flange 28 and shoulder 30 serve as the male side of a coupling for joining two sleeves 10 end to end as shown in FIG. 6. The circular flange 28 mates snugly into the inside diameter of the open upper end 12, while the circular shoulder 30 abuts against the end 12 of the sleeve 10 to form a joint between a first, upper sleeve 10*a* and a second, lower sleeve 10*b*. The two sleeves 10*a* and 10*b* are similar or identical to each other. The coupled sleeves may be employed for starting a screw S' which is longer than the length of either sleeve 10*a* or 10*b* alone. The screw S' is inserted into the joined sleeves by pushing the screw point P' through the bottom closure 16 of the upper sleeve 10*a*, which yields as shown in FIG. 6, until the point P' fits into center hole 18 of the bottom closure 16 of the lower sleeve 10*b*, and the head H' is contained in the upper sleeve 10*a*. The joined sleeves are then used in a manner analogous to that described for the single sleeve 10 in FIGS. 2 through 5. If necessary more than two sleeves 10 can be joined end to end to make up the length necessary to start a given screw.

While particular embodiments of the invention have been described and illustrated for purposes of explanation and example, it must be understood that many changes, modifications, and substitutions to the described embodiments will become apparent to those possessed of ordinary skill in the art without thereby departing from the scope and spirit of the present invention, which is defined by the following claims.

What is claimed is:

1. A disposable holder for facilitating the driving of a pointed screw with a slotted screw head into a workpiece comprising:

a tubular sleeve of uniform inside diameter having an open upper end for receiving a screw to be driven, point supporting means integral with said sleeve at an opposite lower end for supporting the point of said screw in centered relationship to said sleeve, said inside diameter being dimensioned for supporting the screw head against substantial lateral movement such that the screw is supported only at said head and at said point in axial alignment with said sleeve, said point supporting means admitting the end of said pointed screw and rupturing in response to the advance of the shaft of said screw through said point supporting means and into a workpiece positioned against said lower end such that said sleeve is a single use device.

2. The holder of claim 1 further comprising longitudinal slots in said sleeve terminating at said upper end for admitting the blade of a screw driving tool having a blade width greater than said inside diameter into engagement with the slotted screw head in said sleeve.

3. The holder of claim 1 further comprising coupling means at said lower end adapted to couple with said upper end of a similar second sleeve of equal inside diameter for jointly receiving a screw of length greater than that of said sleeve, said supporting means yielding to passage of said screw into said second sleeve and into supporting relationship with said point supporting means on the second sleeve.

4. The holder of claim 1 wherein said point supporting means comprises an end closure of thin material integral with said sleeve.

5. The holder of claim 1 wherein said sleeve is cylindrical and said supporting means comprises a plurality of pie-wedge shaped thin leaf elements closing said lower end and defining a small center hole for supporting the screw in said sleeve with the screw point centered in said sleeve.

6. The holder of claim 8 further comprising longitudinal slots in said sleeve terminating at said upper end for admitting the blade of a screw driving tool having a blade width greater than said inside diameter into engagement with a screw head in said sleeve.

7. A single-use disposable holder of thermoplastic material for facilitating the driving of a pointed screw with a slotted screw head into a workpiece comprising:

a tubular sleeve having an open upper end for receiving the length of a screw to be driven, and an opposite lower end having an end closure molded integrally with said sleeve for retaining the screw in said sleeve, said end closure configured to engage only the pointed end of the screw for supporting said point centered in said sleeve, said end closure rupturing in response to advance of the shaft of said screw therethrough and into a workpiece positioned against said lower end.

8. The holder of claim 7 wherein said end closure comprises a plurality of pie-wedge shaped elements together defining a disc transverse to said sleeve with a screw point receiving hole centered therein.

9. The holder of claim 7 wherein said end closure admits the screw point into contact with the workpiece.

10. The holder of claim 9 wherein said sleeve is relatively thick walled.

11. The holder of claim 7 further comprising diametrically opposed longitudinal slots in said sleeve terminating at said upper end for admitting the blade of a screw driving tool having a blade width greater than said inside diameter into engagement with a screw head in said sleeve.

12. A holder for facilitating the driving of a pointed screw with a slotted screw head into a workpiece comprising:

a tubular sleeve having an open upper end for receiving the screw to be driven, an opposite lower end, said sleeve having a uniform inside diameter between said ends dimensioned for closely receiving the diameter of the screw head, a plurality of pie-wedge shaped elements integral with said sleeve together defining a thin rupturable closure transverse to said sleeve at said lower end with a hole centered therein sized for admitting only the point of said screw and thus retaining the screw in said sleeve while allowing the screw point into contact with a workpiece adjacent to said lower end and for supporting said point centered in said sleeve, thereby to hold the screw in axial alignment in said sleeve, said rupturable means yielding to passage of the shaft of the screw through said lower end.

13. The holder of claim 12 further comprising diametrically opposed longitudinal slots in said sleeve terminating at said upper end for admitting the blade of a screw driving tool having a blade width greater than said internal diameter into engagement with the slotted screw head in said sleeve.

14. The holder of claim 12 further comprising means for joining one said sleeve to a second said sleeve of equal inside diameter, the two sleeves jointly receiving a screw of length greater than that of said sleeve, the rupturable means of the one said sleeve yielding to passage of said screw into the second said sleeve and into supporting relationship with said rupturable means in the second sleeve.

* * * * *